US008646133B2

(12) United States Patent
Tepper

(10) Patent No.: US 8,646,133 B2
(45) Date of Patent: Feb. 11, 2014

(54) DUVET COVER

(76) Inventor: Helen Jane Tepper, Victoria (AU)

( * ) Notice: Subject to any disclaimer, the term of this patent is extended or adjusted under 35 U.S.C. 154(b) by 410 days.

(21) Appl. No.: 12/201,592

(22) Filed: Aug. 29, 2008

(65) Prior Publication Data

US 2010/0050341 A1 Mar. 4, 2010

(51) Int. Cl.
*A47G 9/02* (2006.01)

(52) U.S. Cl.
USPC ..... 5/501; 5/502; 5/485

(58) Field of Classification Search
USPC ..... 5/501, 502, 413 R, 482, 485, 496
See application file for complete search history.

(56) References Cited

U.S. PATENT DOCUMENTS

| | | | | | |
|---|---|---|---|---|---|
| 2,183,360 | A | * | 12/1939 | Sussman | 5/501 |
| 2,799,870 | A | * | 7/1957 | Sullivan | 5/495 |
| 2,810,921 | A | * | 10/1957 | Seidenberg | 5/501 |
| 3,008,152 | A | * | 11/1961 | Seidenberg | 5/501 |
| 3,241,161 | A | * | 3/1966 | Dashosh | 5/501 |
| 4,903,361 | A | * | 2/1990 | Tang | 5/502 |
| 6,446,284 | B1 | * | 9/2002 | Yang | 5/502 |
| 2004/0031098 | A1 | | 2/2004 | Hollander | |
| 2005/0144721 | A1 | | 7/2005 | Linnane | |

FOREIGN PATENT DOCUMENTS

| | | | | | |
|---|---|---|---|---|---|
| AU | 698265 | | | 10/1998 | |
| CN | 21022559 | | | 2/2008 | |
| DE | 1810372 | A1 | | 6/1970 | |
| DE | 29912542 | U1 | | 10/1999 | |
| GB | 2142233 | | | 6/1983 | |
| GB | 2273870 | A | * | 7/1994 | 5/496 |
| GB | 2389523 | A | | 12/2003 | |
| GB | 2440822 | | | 8/2007 | |

OTHER PUBLICATIONS

International Search Report and Written Opinion for corresponding International Application No. PCT/AU2009/001093, filed Aug. 25, 2009.

European Search Report dated Nov. 18, 2011 for corresponding European Application No. 09 80 9099.6.

* cited by examiner

*Primary Examiner* — Michael Trettel
(74) *Attorney, Agent, or Firm* — David D. Brush; Westman, Champlin & Koehler, P.A.

(57) ABSTRACT

A duvet cover (10) including an envelope portion (20) substantially closable for enveloping a duvet to shield the duvet from soiling. The envelope portion (120) is removable from the duvet for laundering. The duvet cover further includes a sheet portion (30) attachable to the envelope portion (20) to underlie the envelope portion (20) to shield the underside (21) of the envelope portion (20) from soiling. The sheet portion (30) is removable from the envelope portion (20) for laundering. There is also provided a method of minimizing duvet cover laundering requirements.

15 Claims, 2 Drawing Sheets

DUVET COVER

FIELD OF THE INVENTION

The invention relates to a duvet cover for shielding a duvet from soiling.

BACKGROUND OF THE INVENTION

Traditional western style bedding includes a bottom sheet overlying a mattress. The bottom sheet is typically tightly fitted about the periphery of the mattress. A top sheet then overlies the bottom sheet and is in turn overlaid by one or more blankets. The head end of the sheet (the portion of the sheet towards the head of the bed) is then commonly folded back over the blankets to define a fold back portion protecting the blankets from soiling. The top sheet and blankets are then tucked under the periphery of the mattress about the two sides and the foot end of the bed so that the top sheet and the blankets are tightly held in place.

The daily task of arranging the sheets and blankets on the bed is a tiresome chore. Additionally, many people do not like the 'tight' feeling of being tucked in. A popular alternative to such conventional bedding is the use of a duvet. A duvet (as used herein) is a closed envelope of fabric containing an insulating material such as wool or goose down. The duvet, which is typically rectangular, can be placed over the top of the bed to quickly and easily present a reasonably attractive appearance. The duvet also provides a looser feel that many people prefer.

Laundering a duvet is difficult in that the insulating material is not readily removable. To minimise the requirement for laundering of the duvet often a duvet cover is provided. Typically, duvet covers include two rectangular panels permanently fastened (e.g. by stitching) about their 2 sides and along the head end to define an envelope. The foot end is left open to define an opening for inserting and removing the duvet. The opening is typically held closed by some form of releasable fastener such as a zipper or hook and loop fastening so that the duvet cover is substantially closed and the duvet is retained within the duvet cover.

Inserting and removing the duvet from such a cover can be problematic. It is sometimes difficult to align the corners of the duvet with the inside corners of the cover and, particularly in the case of larger sized duvets, frequently requires two people to locate all four corners and shake out the duvet and duvet cover so that the duvet is evenly spread out within the duvet cover.

UK Patent Application GB 2142233 describes providing a protective sheet attachable to the underside of the duvet to separate the duvet from the occupant of the bed. This approach is thought to provide inadequate protection for the duvet from soiling.

Australian Petty Patent 698265 describes the provision of a protective cover which overlies the top surface of the duvet and includes perimeter edges folded back towards each other to underlie a peripheral margin of the underside of the duvet. These fold back portions frame an opening through which the duvet may be inserted. The opening is closed by a top sheet attachable to the fold back portions. This is thought to be only an incremental advance on the conventional duvet cover in that inserting the duvet requires the protective cover to be laid out and then for the edges of the duvet to be aligned within the fold back portions. This alignment is thought to be troublesome and difficult.

It is not admitted that any of the information in this specification is common general knowledge, or that the person skilled in the art could be reasonably expected to have ascertained, understood, regarded it as relevant or combined it in anyway at the priority date.

It is an object of the invention to provide an improved duvet cover, or at least to provide an alternative in the market.

SUMMARY OF THE INVENTION

In one aspect of the invention there is provided a duvet cover including:

an envelope portion substantially closable for enveloping a duvet to shield the duvet from soiling, the envelope portion being removable from the duvet for laundering; and a sheet portion attachable to the envelope portion to underlie the envelope portion to shield the underside of the envelope portion from soiling, the sheet portion being removable from the envelope portion for laundering.

The envelope portion and the sheet portion may each include complementary fastening means for releasably fastening the sheet portion and the envelope portion at least about a peripheral margin of an underside of the envelope portion. Preferably the fastening means is a plurality of press studs spaced about the peripheral margin.

The sheet portion may be dimensioned to in use lie within at least 3 edges of the envelope portion. Advantageously, the sheet portion may include a portion that in use extends beyond a head edge of the envelope portion and is folded to define a fold back portion to shield a head portion of an upper surface of the envelope portion adjacent to the head edge from soiling. The fold back portion and the head portion of the upper surface of the envelope portion may each include complementary fold back portion fastening means for fastening the fold back portion to the head portion of the upper surface. The fold back fastening means is preferably a plurality of press studs. An opening may extend transversely across the upper surface of the envelope portion for inserting and removing the duvet from the envelope portion. The opening may be proximal and substantially parallel to an edge of the fold back portion. Opening fastening means for releasably closing the opening may be provided. The opening fastening means is preferably a plurality of press studs.

Advantageously, the sheet portion may be of a contrasting colour and/or pattern to the envelope portion.

In another aspect of the invention there is provided a method of minimising duvet cover laundering requirements including the step of releasably fastening a sheet portion to an underside of a substantially closed envelope portion of a duvet cover. Preferably this includes the use of a duvet cover according to the invention.

It will be understood that the invention disclosed and defined in this specification extends to all alternative combinations of two or more of the individual features mentioned or evident from the text or drawings. All of these different combinations constitute various alternative aspects of the invention.

BRIEF DESCRIPTION OF THE DRAWINGS

The invention will now be described, by way of example only, with reference to the accompanying figures in which.

DETAILED DESCRIPTION OF THE EMBODIMENTS

Figure 1:
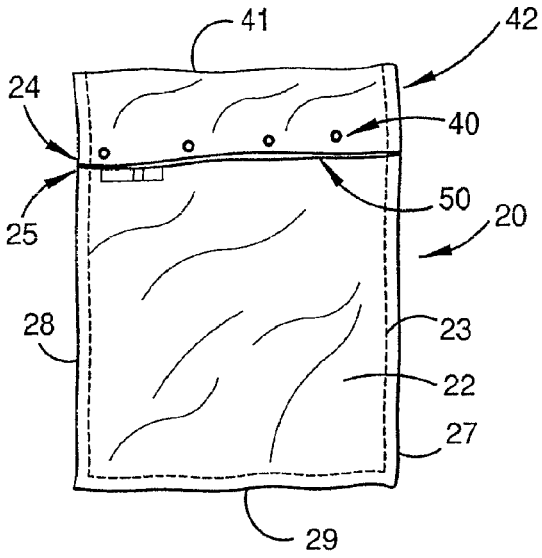
FIG. 1 is a top view of the envelope portion of a duvet cover in accordance with a preferred embodiment of the invention.
Figure 2:
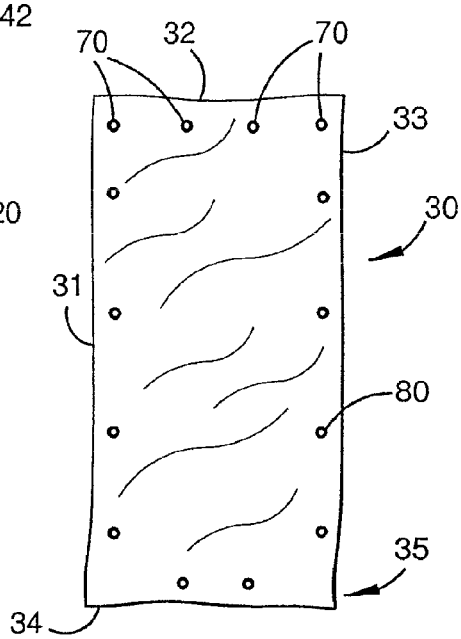
FIG. 2 is a top view of a sheet portion of a duvet cover in accordance with a preferred embodiment of the invention.

As illustrated, the duvet cover 10 includes two principal components: an envelope portion 20 and a sheet portion 30. The envelope portion 20 is configured to receive a duvet (not shown). The sheet portion 30 is attachable to the envelope portion 20 to shield the envelope portion 20 from soiling.

The envelope portion 20 includes a rectangular lower surface 21 and a rectangular upper surface 22 fastened about their 4 edges respectively to define a rectangular envelope dimensioned to receive a duvet (not shown). An opening 50, in the form of a slit extends transversely across the upper surface 22 of the envelope portion 20 and provides an access point for inserting and removing the duvet. Releasable fasteners (not shown) are used to hold the opening 50 closed. In this embodiment, press studs (not shown) are spaced along the length of the opening 50. Of course, other fasteners, such as zippers or hook and loop fastening, may be used.

The envelope portion 20 is preferably formed by a single strip of fabric folded at a foot edge 29 of the envelope portion 20 and at a head edge 41 of the envelope portion 20. The ends 24, 25 of the strip meet at the opening 50. Stitching 23 along the sides 27, 28 and the foot edge 29 of the envelope portion 20 assist in maintaining the shape of the envelope portion 20. The end portions 24, 25 of the strip forming opening 50 are suitably hemmed.

Figure 3:
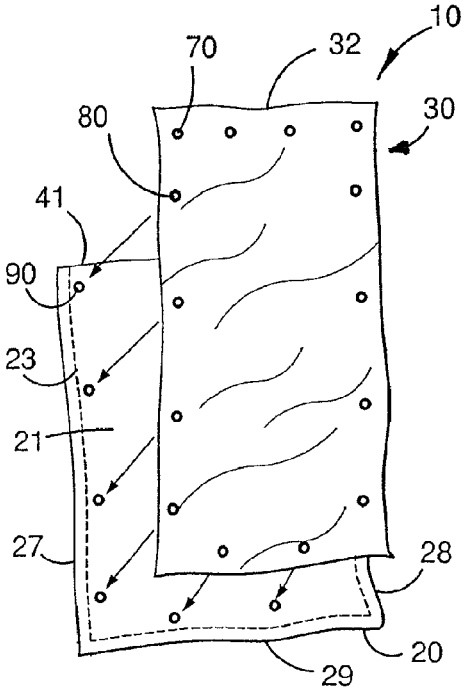
FIG. 3 is a bottom view illustrating the attachment of the sheet portion of FIG. 2 to the envelope portion of FIG. 1.

As best illustrated in FIG. 3, the envelope portion 20 includes press studs 90 spaced around peripheral margins of the lower surface 21 of the envelope portion 20 adjacent to the foot edge 29 and side edges 27, 28. In this embodiment, the press studs 90 are each positioned about 50 mm from the nearest edge 27, 28, 29.

The sheet portion 30 is a suitably dimensioned rectangular web of fabric. Each edge 31, 32, 33, 34 is suitably hemmed. Spaced about peripheral margins adjacent the foot edge 34 and the side edges 31, 33 of the sheet portion 30 are press studs 80 which are complementary to the press studs 90. The press studs 80 are positioned within about 15 mm of the nearest edge 31, 33, 34 of the sheet portion 30.

In use the press studs along the opening 50 are released and the duvet (not shown) is inserted into the envelope portion 20. The press studs along the opening 50 are subsequently fastened to hold closed the envelope portion 20. Then, as best illustrated in FIG. 3, the press studs 80 and 90 are aligned and fastened so that the sheet portion 30 is attached to the envelope portion 20.

The sheet portion 30 is preferably longer than the envelope portion 20. The additional length provides an end portion foldable back over the head edge 41 of the envelope portion 20 to form a fold back portion 60 to overlie a head portion 42 of the upper surface 22 of the envelope portion 20. The head portion 42 is preferably about 300 mm wide. This protects the head portion 42 of the upper surface 22 from soiling and creates an attractive appearance more in line with conventional bedding.

Figure 4:
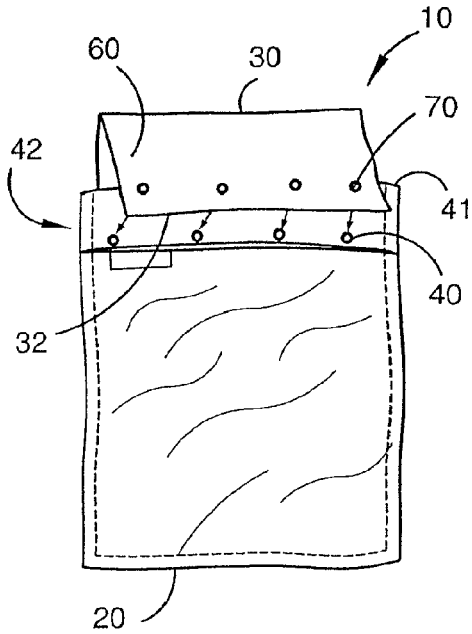
FIG. 4 is a top view illustrating the attachment of the fold back portion of the sheet portion of FIG. 2 to the envelope portion of FIG. 1.
Figure 5:
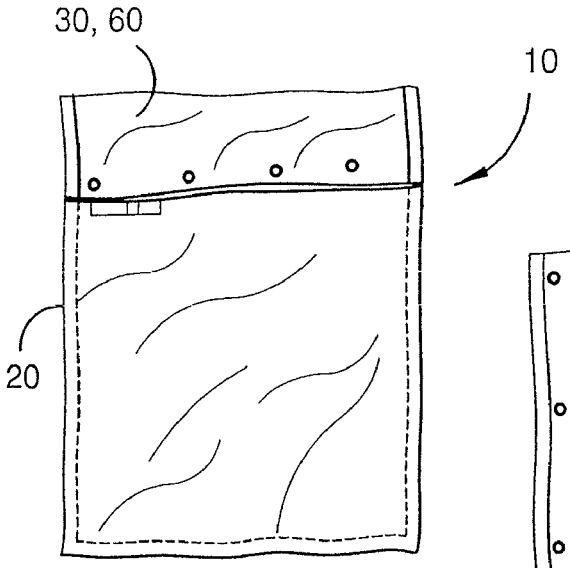
FIG. 5 is a top view of the assembled duvet cover including the envelope portion of FIG. 1 and the sheet portion of FIG. 2.

The upper surface 22 of the envelope portion 20 includes a series of spaced press studs 40 along the length of and adjacent to the opening 50. The press studs 40 are spaced about 20 mm from the opening 50 towards the head edge 41 of the envelope portion 20. The sheet portion 30 includes press studs 70 complementary to the press studs 40 spaced along an end edge 32 of the fold back portion 60. As best illustrated in FIG. 4, the press studs 40 and 70 are engagable to hold the fold back portion 60 in position on the upper surface 22 of the duvet cover 20.

Figure 6:
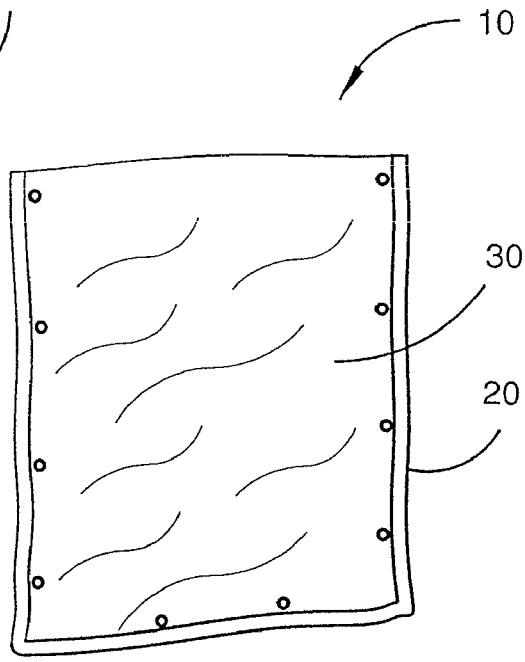
FIG. 6 is a bottom view of the assembled duvet cover of FIG. 5.
Figure 7:
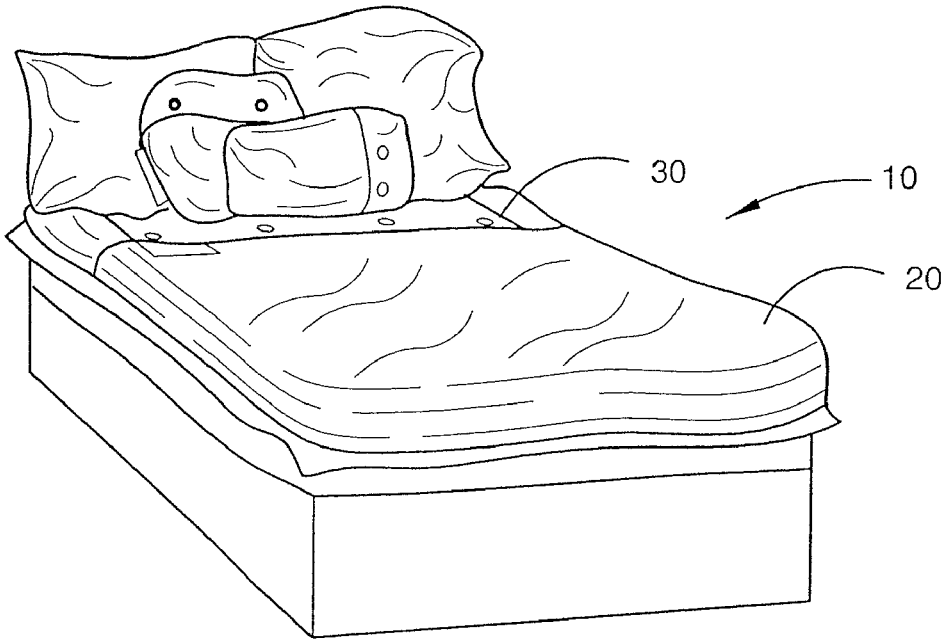
FIG. 7 is a perspective view of the duvet cover of FIG. 5 in situ.

As best illustrated in FIG. 6, the sheet portion 30 is dimensioned to lie within the edges 27, 28, 29 of the envelope portion 20 so that the duvet and duvet cover 10 in use can be easily thrown over the bed, as per a conventional duvet cover, without presenting an untidy edge of the sheet portion 30. Of course, other variations are possible. For example, the edges 31, 33, 34 of the sheet portion 30 may extend beyond the edges 27, 28, 29 of the envelope portion 20 to create the appearance of valance. Alternatively, these extended edges could be tucked into the mattress to create a tight feel, like conventional bedding, that is preferred by some people.

This construction allows for the duvet to be fully protected from soiling by the envelope portion 20 and for the envelope portion 20 to be protected from soiling via direct contact with a person by the sheet portion 30. The sheet portion 30 can be readily removed, by releasing the press studs, 80, 90 and 40, 70, for more frequent laundering. This construction means that hygiene is maintained by regular washing of the sheet portion 30 and that the difficulties of inserting the duvet into the envelope portion 20 occur less frequently. A further advantage of this construction is the ability to mix and match colours—having an envelope portion 20 and a sheet portion 30 of differing contrasting colours has been found to be particularly attractive, and of course a variety of sheet portions 30 of differing colours may be separately used with an envelope portion 20.

The claims defining the invention are as follows:

1. A bedding cover including:

an envelope portion for enveloping a duvet to shield the duvet from soiling, the envelope portion having a head edge, an in-use upwardly disposed upper surface and an in-use downwardly disposed underside and being removable from the duvet for laundering, the envelope portion having a substantially closable access point across at least a portion of the upper surface and spaced from the head end for inserting and removing the duvet; and a sheet portion attachable to the envelope portion to underlie the envelope portion to shield the underside of the envelope portion from soiling, the sheet portion being removable from the envelope portion for laundering and having a portion that in-use extends beyond the head edge of the envelope portion and is folded to define a fold back portion to shield a head portion of the upper surface of the envelope portion adjacent to the head edge from soiling, the fold back portion having an edge adjacent to the access point.

2. The bedding cover of claim 1 wherein the envelope portion and the sheet portion each include complementary fastening means for releasably fastening the sheet portion and the envelope portion at least about a peripheral margin of the underside of the envelope portion.

3. The bedding cover of claim 2 wherein the fastening means is a plurality of press studs spaced about the peripheral margin.

4. The bedding cover of claim 1 wherein the sheet portion is dimensioned to in use lie within at least 3 edges of the envelope portion.

5. The bedding cover of claim 1 wherein the fold back portion and the head portion of the upper surface of the envelope portion each include complementary fold back portion fastening means for fastening the fold back portion to the head portion of the upper surface of the envelope portion.

6. The bedding cover of claim 5 wherein the fold back fastening means is a plurality of press studs.

7. The bedding cover of claim 1, wherein the access point comprises a slit that extends transversely across the upper surface of the envelope portion for inserting and removing the duvet from the envelope portion, the slit being proximal and substantially parallel to the edge of the fold back portion.

8. The bedding cover of claim 7 including opening fastening means for releasably closing the slit.

9. The bedding clover of claim 8 wherein the opening fastening means is a plurality of press studs.

10. The bedding cover of claim 1 wherein the sheet portion is of a contrasting colour and/or pattern to the envelope portion.

11. The bedding cover of claim 1, wherein the envelope portion comprises a foot edge, first and second side edges, and wherein the sheet portion comprises at least one fastener, which removably fastens the sheet portion to the downwardly disposed underside of the envelope portion, along at least the first and second side edges such that the sheet portion shields the underside of the envelope portion from soiling.

12. The bedding cover of claim 11, wherein the at least one fastener is selected from the group consisting of a press stud, a zipper, and a hook and loop.

13. A method of minimising bedding cover laundering requirements including:

enveloping a duvet with an envelope portion of a substantially closable duvet cover to shield the duvet from soiling, the envelope portion comprising a head edge, an in-use upwardly disposed upper surface and an in-use downwardly disposed underside and being removable from the duvet for laundering, the envelope portion having a substantially closable access point across at least a portion of the upper surface and spaced from the head end for inserting and removing the duvet;

releasably fastening an upper sheet portion to the underside of the envelope portion to shield the underside from soiling, the sheet portion being removable from the envelope portion for laundering and having a portion that in-use extends beyond the head edge of the envelope portion and is folded to define a fold back portion to shield a head portion of the upper surface of the envelope portion adjacent to the head edge from soiling, the fold back portion having an edge adjacent to the access point.

14. The method of claim 13, wherein the envelope portion comprises a foot edge, first and second side edges, and wherein releasably fastening comprises fastening the upper sheet portion along at least the first and second side edges of the envelope portion such that the upper sheet portion shields the underside of the envelope portion from soiling.

15. The method of claim 14, wherein releasably fastening comprises fastening with at least one fastener selected from the group consisting of a press stud, a zipper, and a hook and loop.

* * * * *